US010359247B1

(12) United States Patent
Ballard

(10) Patent No.: US 10,359,247 B1
(45) Date of Patent: Jul. 23, 2019

(54) FOLDING STOCK WITH BARREL CLAMP

(71) Applicant: Pro Mag Mfg., Inc., Phoenix, AZ (US)

(72) Inventor: Michael Wayne Ballard, Surprise, AZ (US)

(73) Assignee: PRO MAG MFG., INC., Phoenix, AZ (US)

( * ) Notice: Subject to any disclaimer, the term of this patent is extended or adjusted under 35 U.S.C. 154(b) by 13 days.

(21) Appl. No.: 15/865,466

(22) Filed: Jan. 9, 2018

(51) Int. Cl.
*F41C 7/11* (2006.01)
*F41A 11/04* (2006.01)
*F41C 23/04* (2006.01)

(52) U.S. Cl.
CPC ..... *F41A 11/04* (2013.01); *F41C 7/11* (2013.01); *F41C 23/04* (2013.01)

(58) Field of Classification Search
CPC ..... F41C 23/04; F41C 23/14; F41C 27/00; F41C 7/11; F41A 11/04; F41A 21/48
See application file for complete search history.

(56) References Cited

U.S. PATENT DOCUMENTS 1,779,770 A * 10/1930 Harrington ..... F41A 11/04 42/40
2,154,517 A * 4/1939 Lewis ..... F41C 7/11 42/40
5,020,260 A * 6/1991 Houghton ..... F41A 11/04 42/75.01
6,470,617 B1 * 10/2002 Gregory ..... F41C 7/11 42/75.02
7,841,121 B1 * 11/2010 Barrett ..... F41A 11/04 42/75.02
9,995,556 B2 * 6/2018 Hall ..... F41C 7/11
2010/0071541 A1 * 3/2010 Barrett ..... F41A 5/18 89/191.01
2010/0281742 A1 * 11/2010 Barrett ..... F41A 11/04 42/75.02

(Continued)

FOREIGN PATENT DOCUMENTS

EP 2078916 A2 * 7/2009 ..... F41A 11/04

OTHER PUBLICATIONS

David Fortier, "3 Great Takedown Survival Guns," http://www.rifleshootermag.com/survival/3-great-22lr-takedown-survival-guns/, Mar. 19, 2015, Accessed Dec. 14, 2017.

(Continued)

*Primary Examiner* — Benjamin P Lee
(74) *Attorney, Agent, or Firm* — Bennet K. Langlotz; Langlotz Patent & Trademark Works, LLC

(57) ABSTRACT

A folding stock with barrel toggle clamp has a body defining a receptacle adapted to receive the action, a clamp mechanism on the body operable to move between a released position and a clamped position, and the clamp mechanism operable to bias the barrel toward the receptacle to secure the barrel to the action. The clamp mechanism may be a multi-link linkage. One of the links may have an adjustable length. The clamp mechanism may include a lever that is flush against an external surface of the stock when in the clamped position. The clamp mechanism may include a V-block defining a channel adapted to receive a protrusion on the receiver and an angled surface on the barrel to clamp the barrel to the receiver. The clamp mechanism may include a lever pivotally connected to the body to pivot on a first horizontal axis lateral to the body.

30 Claims, 10 Drawing Sheets

(56) References Cited

U.S. PATENT DOCUMENTS

| | | | | |
|---|---|---|---|---|
| 2014/0196345 | A1* | 7/2014 | Grimshaw | F41C 23/04 42/73 |
| 2015/0184957 | A1* | 7/2015 | Guerini | F41A 3/06 42/40 |
| 2016/0116250 | A1* | 4/2016 | Mather | F41C 23/04 42/73 |
| 2018/0023918 | A1* | 1/2018 | Smith | F41C 23/04 |
| 2018/0058802 | A1* | 3/2018 | Hall | F41C 7/11 |

OTHER PUBLICATIONS

Sturm, Ruger & Co., Inc., "Ruger(R) 10/22 Takedown(R)," https://ruger.com/products/1022Takedown/models.html, (c) 2017, Accessed Dec. 14, 2017.

Brownells, Inc., "AGP Arms Inc—RUGER® 10/22® Takedown Folding Stock Kit," https://www.brownells.com/rifle-parts/stock-parts/rifle-stocks/ruger-10-22-takedown-folding-stock-kit-prod85214.aspx?avs%7cMake%7e%7eModel_1=Ruger_10zz1zz22%2bTakedown, (c) 2017, Accessed Dec. 14, 2017.

* cited by examiner

FOLDING STOCK WITH BARREL CLAMP

FIELD OF THE INVENTION

The present invention relates to a folding stock with barrel toggle clamp that converts a conventional rifle to a takedown rifle.

BACKGROUND OF THE INVENTION

Takedown rifles are long guns designed for easy disassembly to reduce their length, thus making them easier to store and transport. Numerous barrels, stocks, and receivers have been developed to facilitate takedown.

Ruger® 10/22® rifles manufactured by Sturm, Ruger & Co., Inc. of Southport, Conn. are one of the most popular rifles ever produced. A takedown version of the 10/22® was introduced in 2012. The takedown version enables the barrel to be easily separated from the action and stock by pushing a recessed lever, twisting the barrel relative to the action, and pulling them apart. The standard barrel length is 18 inch, and a shorter 16.12 inch variant is also available. The standard non-takedown version of the rifle has a barrel length of 20 inch.

A disadvantage of the takedown version of the 10/22® is the lack of a storage location in the stock for the barrel. The U.S. Survival AR-7 rifle manufactured by Henry Repeating Arms Co. of Bayonne, N.J. overcomes this difficulty by enabling storage of the barrel, the receiver, and two eight-round magazines within the stock. However, the U.S. Survival AR-7 rifle is limited to a barrel length of 16.1 inch so the barrel will completely fit within the stock.

Neither of these prior art takedown rifles offer a folding stock, although third-party folding stocks for the 10/22® takedown version exist. Furthermore, both require the use of the original equipment manufacturer's barrel to retain their takedown capability unless the original stock is also replaced along with the barrel. Finally, both utilize shorter barrels than may be desired by the user, or a user who already has a standard 10/22® rifle who would like to convert it to a takedown rifle.

Therefore, a need exists for a new and improved folding stock with barrel toggle clamp that converts a conventional rifle to a takedown rifle. In this regard, the various embodiments of the present invention substantially fulfill at least some of these needs. In this respect, the folding stock with barrel toggle clamp according to the present invention substantially departs from the conventional concepts and designs of the prior art, and in doing so provides an apparatus primarily developed for the purpose of converting a conventional rifle to a takedown rifle.

SUMMARY OF THE INVENTION

The present invention provides an improved folding stock with barrel toggle clamp, and overcomes the above-mentioned disadvantages and drawbacks of the prior art. As such, the general purpose of the present invention, which will be described subsequently in greater detail, is to provide an improved folding stock with barrel toggle clamp that has all the advantages of the prior art mentioned above.

To attain this, the preferred embodiment of the present invention essentially comprises a body defining a receptacle adapted to receive the action, a clamp mechanism on the body operable to move between a released position and a clamped position, and the clamp mechanism operable to bias the barrel toward the receptacle to secure the barrel to the action. The clamp mechanism may be a multi-link linkage. One of the links may have an adjustable length. The clamp mechanism may include a lever that is flush against an external surface of the stock when in the clamped position. The clamp mechanism may include a V-block defining a channel adapted to receive a protrusion on the receiver and an angled surface on the barrel to clamp the barrel to the receiver. The clamp mechanism may include a lever pivotally connected to the body to pivot on a first horizontal axis lateral to the body. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
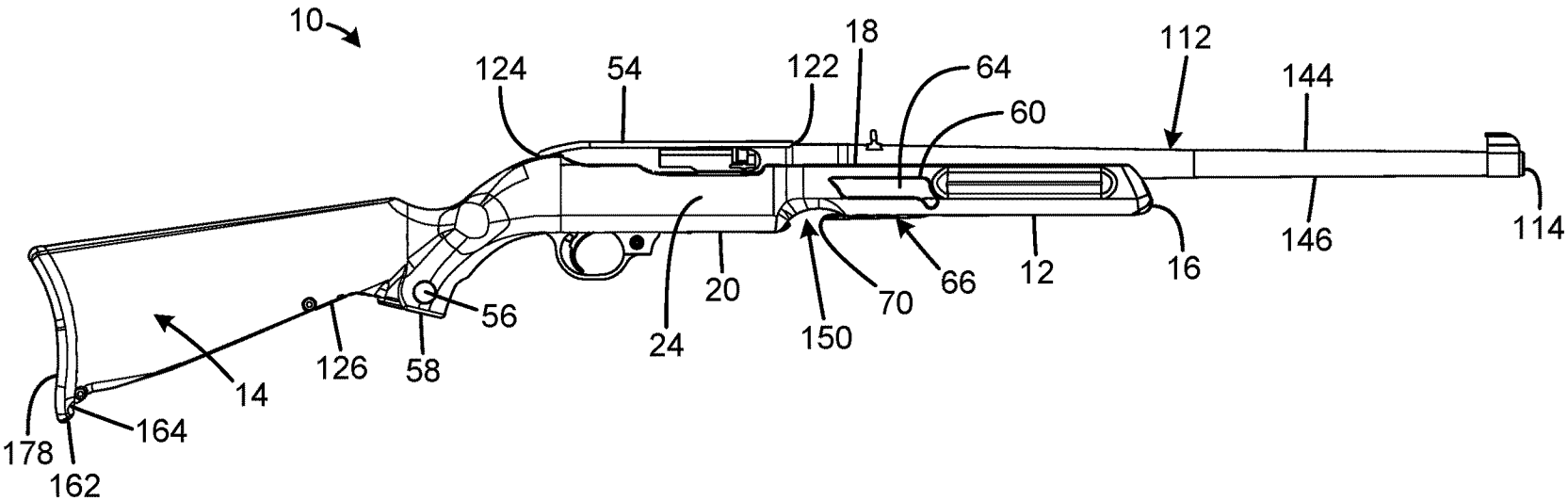
FIG. 1 is a right side view of the current embodiment of the folding stock with barrel toggle clamp constructed in accordance with the principles of the present invention.
Figure 2:
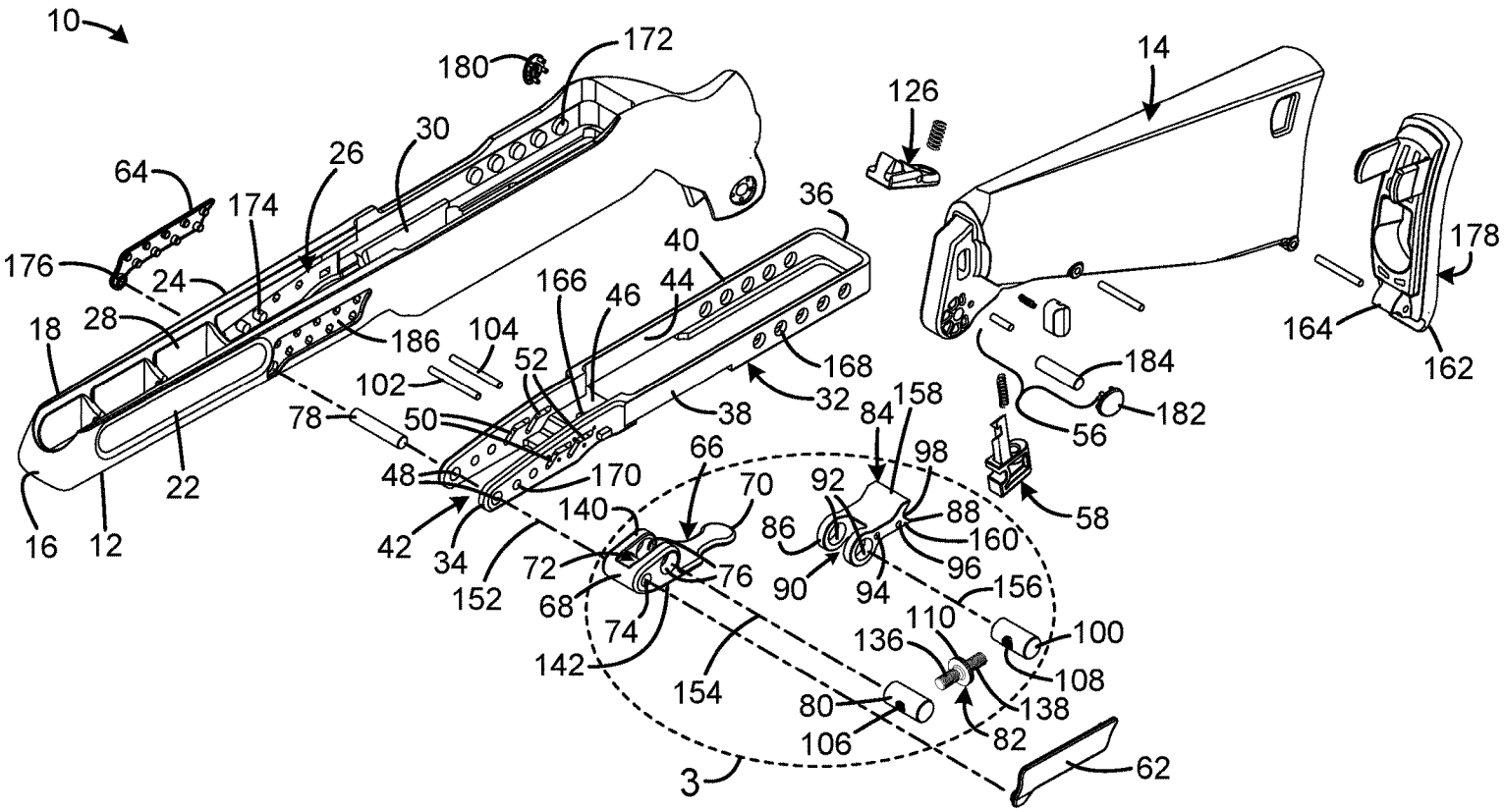
FIG. 2 is an exploded view of the folding stock with barrel toggle clamp of FIG. 1 without the receiver and barrel.
Figure 3:
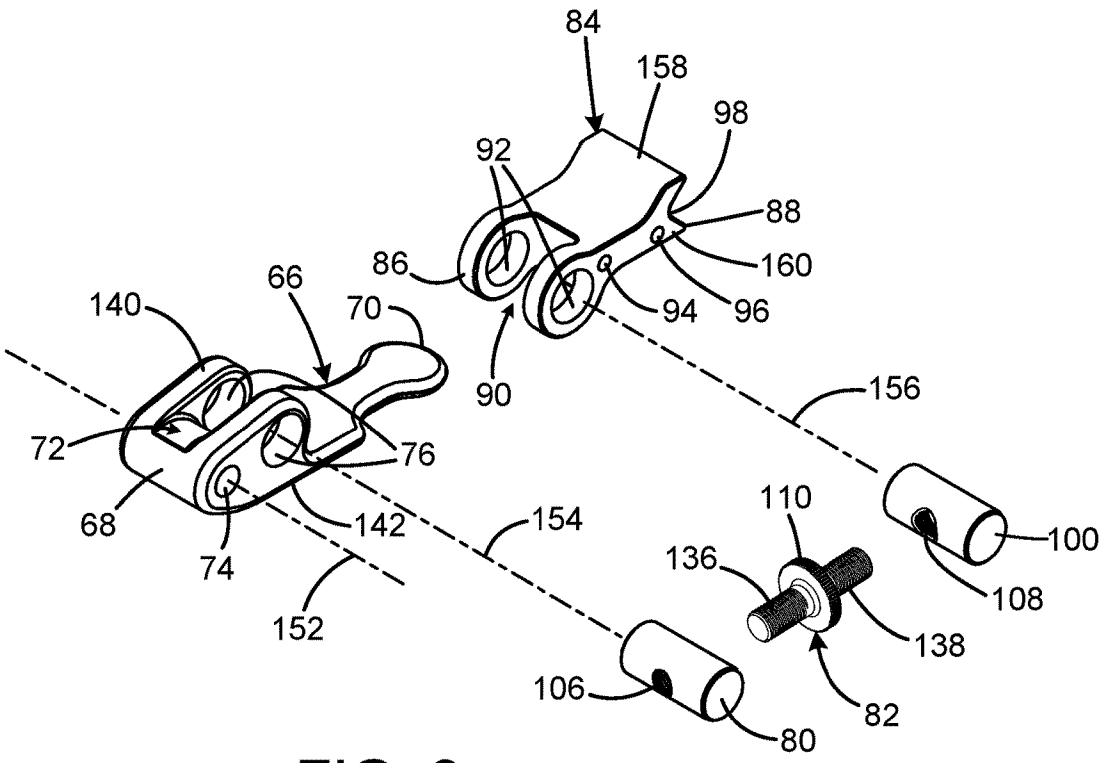
FIG. 3 is an enlarged view of the circled area 3 of FIG. 2.
Figure 4:
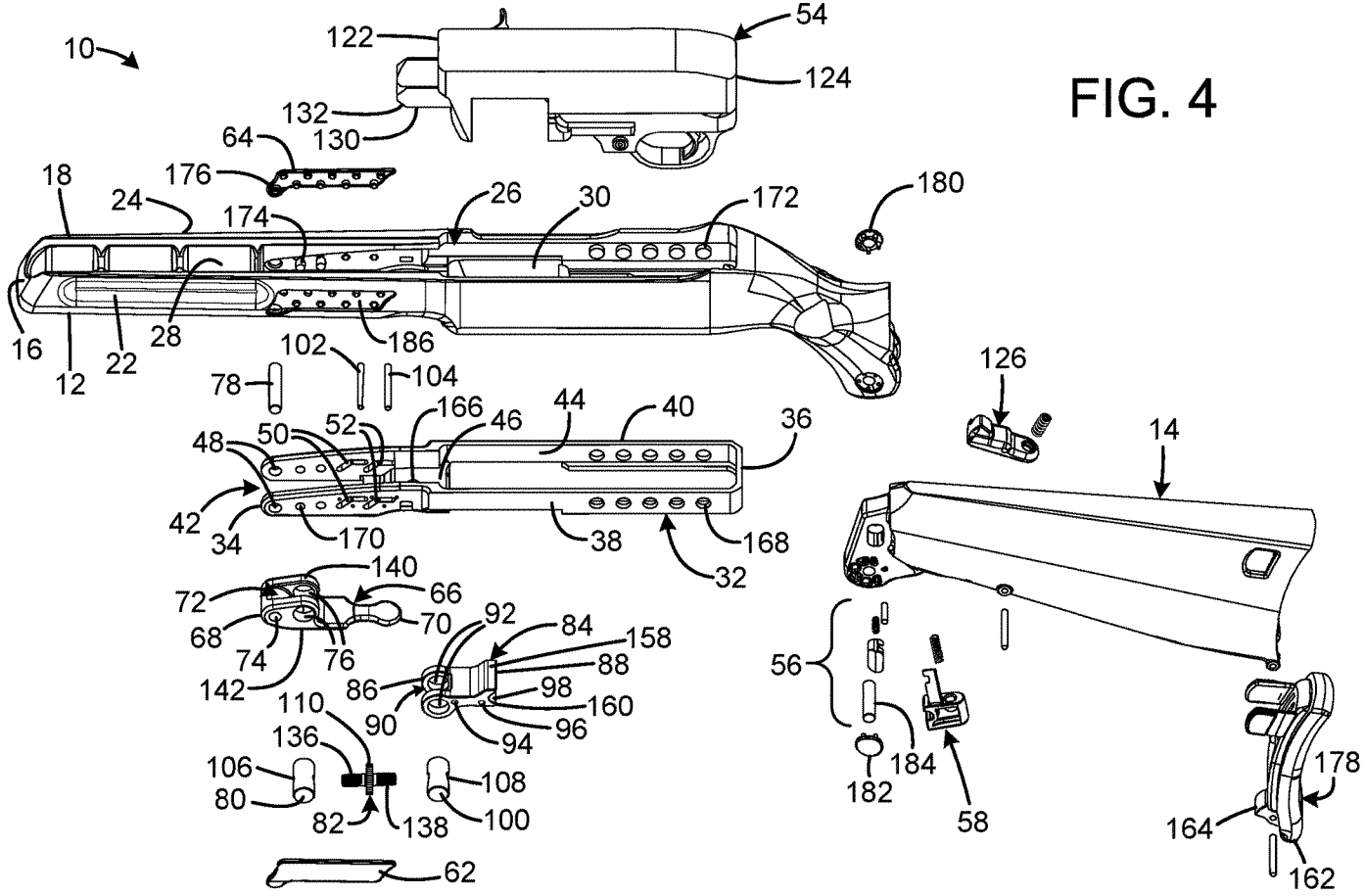
FIG. 4 is an exploded view of the folding stock with barrel toggle clamp of FIG. 1 with the receiver and without the barrel.

A preferred embodiment of the folding stock with barrel toggle clamp of the present invention is shown and generally designated by the reference numeral 10.

FIGS. 1-4 illustrate the improved folding stock with barrel toggle clamp 10 of the present invention. More particularly, the stock is shown in the unfolded position for use in FIG. 1. The stock is an elongated plastic body that has a forend 12, butt 14, recoil pad 178, front 16, top 18, bottom 20, left side 22, and a right side 24. The top defines an elongated channel 26 with a forward barrel channel portion 28 and a rearward receiver channel portion 30. An action/receiver 54 having a front 122 and rear 124 is received within the receiver channel portion, which is a receptacle adapted to receive the action/receiver.

The stock 10 includes an overmolded insert/chassis 32 occupying a portion of the barrel channel and receiver channel portions 28, 30, which is made of aluminum in the current embodiment to provide strength to the stock. The chassis has a front 34, rear 36, left side 38, and right side 40.

The front of the chassis defines a barrel slot 42. The rear of the chassis defines a receiver slot 44. A floor plate 46 extends laterally to connect the left side of the chassis to the right side. Two axially registered apertures 48 are defined in the front of the chassis. Axially registered front guide slots 50 and rear guide slots 52 are defined in the front of the chassis adjacent to the floor plate. The front and rear guide slots are shaped like an inverted V with the rearmost leg of the V shape being oriented parallel to the chassis. The left side 22 and right side 24 of the forend 12 of the stock define a right recess 60 and a left recess 186 that are laterally aligned with the front portion of the chassis. A left cover plate 62 and a right cover plate 64 are releasably secured within the right and left recesses. The left and right cover plates are rubber overmolded for ergonomic comfort and permit installation of the required pins in the stock without leaving any exposed pins. The floor plate 46 of the chassis defines an aperture 166 that receives a pin (not shown) to connect the receiver 54 to the chassis. Apertures 168 in the rear of the chassis and apertures 170 in the front of the chassis are engaged by protrusions 172 in the receiver channel portion 30 and protrusions 174 in the barrel channel portion 28 to secure the chassis within the channel 26 of the stock 10.

A planar lever 66, turnbuckle 82, and V-block 84 are a clamp mechanism on the stock/body received within the barrel slot 42 of the chassis 32 that are operable to move between a released position and a clamped position to releasably clamp the rear 116 of a barrel 112 within the front 122 of the receiver 54. The clamp mechanism is a multi-link linkage where one of the links (the turnbuckle) has an adjustable length. The lever has a front 68, rear 70, top 140, and bottom 142. The top front of the lever defines a slot 72. The front of the lever defines two axially registered apertures 74 (only one of which is visible) that are walled off from the slot, and two axially registered apertures 76 that are in communication with the slot. The lever is pivotally retained within the barrel slot of the chassis by a pivot pin 78 that is received by apertures 48 in the barrel slot and apertures 74 in the lever. Protrusion 176 on the right cover plate 64 and a matching protrusion (not visible) on the left cover plate are axially registered with the pivot pin and ensure the pivot pin remains centered. The front 34 of the chassis 32 is a forward extending element defining a facility connected to the clamp mechanism, such that compression generated by the clamping mechanism between the barrel 112 and action/receiver 54 is supported by tension in the chassis. A pin/barrel nut 80 having a threaded aperture 106 that is perpendicular to the apertures 76 is rotatably received within the apertures 76 in the lever. The turnbuckle has a front threaded end 136 threadedly engaged with threaded aperture 106. The turnbuckle also has a rear threaded end 138 that is separated from the front threaded end by a thumb wheel 110 that facilitates rotation of the turnbuckle. The turnbuckle is a shaft having oppositely threaded ends, such that rotation of the shaft enables adjustment of an effective length of the turnbuckle link.

The V-block 84 has a front 86 and rear 88. The front of the V-block defines a slot 90 and two axially registered apertures 92 that are in communication with the slot. Two axially registered apertures 94 that do not communicate with the slot are defined in the V-block behind the apertures 92. Two axially registered apertures 96 are defined behind apertures 94. The rear of the V-block defines a V notch 98 that is a channel defined between an upper leg 158 and a lower leg 160. A barrel nut 100 having a having a threaded aperture 108 is received within the apertures 92 in the V-block. The rear threaded end 138 of the turnbuckle is threadedly engaged with the threaded aperture 108. The V-block is slidably retained within the barrel slot 42 of the chassis 32 by front guide pin 102 and rear guide pin 104. The front guide pin is received by the front guide slots 50 and the apertures 94. The rear guide pin is received by the rear guide slots 52 and the apertures 96.

Figure 5:
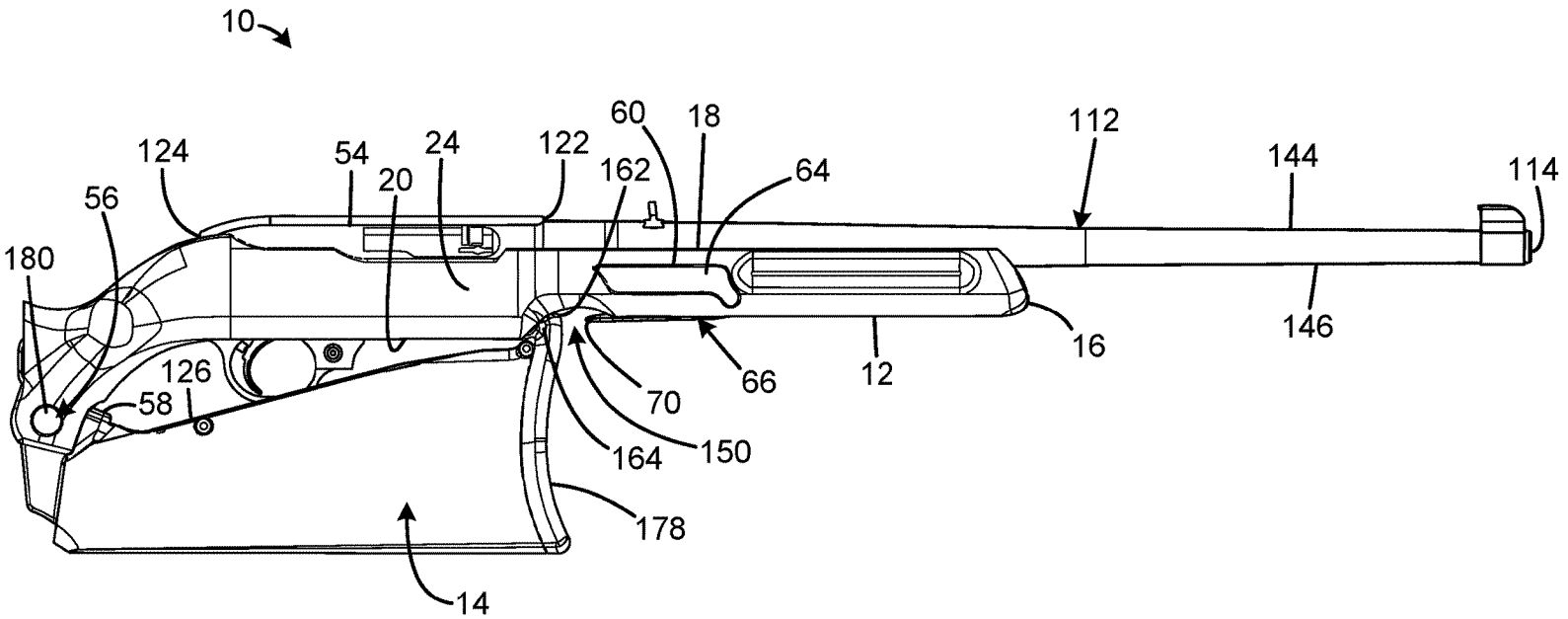
FIG. 5 is a right side view of the folding stock with barrel toggle clamp of FIG. 1 with the stock in the folded position.
Figure 6:
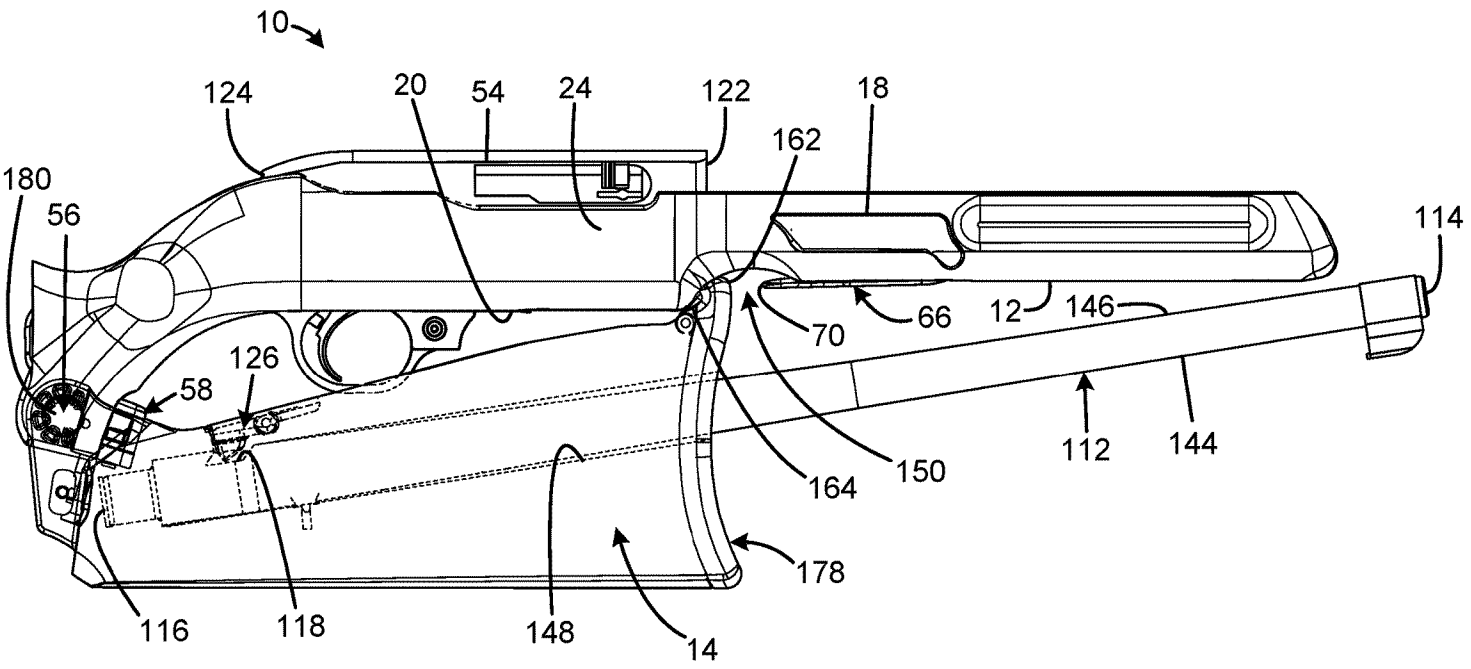
FIG. 6 is a right side view of the folding stock with barrel toggle clamp of FIG. 1 with the stock in the folded position and the barrel stowed in the stock.

FIGS. 5 and 6 illustrate the improved folding stock with barrel toggle clamp 10 of the present invention. More particularly, the stock is shown in the folded position in FIG. 4 with the barrel still installed. In FIG. 6, the barrel 112 is shown stowed in the butt 14 of the stock. The stock includes a hinge with latch mechanism 56 having a release button 58. When the release button is depressed, the latch mechanism is released, and the butt of the stock is free to pivot about the hinge into the folded position shown in FIGS. 5 and 6. Right and left hinge caps 180, 182 hide the hinge pin 184. The right and left hinge caps are indexed and lettered for ease of assembly. The toe 162 of the recoil pad 178 has a latching mechanism 164 that releasably holds the stock in the folded position. The barrel can also be released from the front 122 of the receiver 54 and stowed with its rear 116 inside a barrel compartment 148 in the butt of the stock with the muzzle 112 protruding just beyond the front 16 of the forend 12. The rear of the barrel is releasably retained within the barrel compartment by a barrel retention latch 126 that engages a notch 118 in the bottom 146 of the barrel. When the barrel retention latch is depressed, the barrel retention latch disengages from the notch to enable the barrel to be withdrawn from the barrel compartment.

Figure 7:
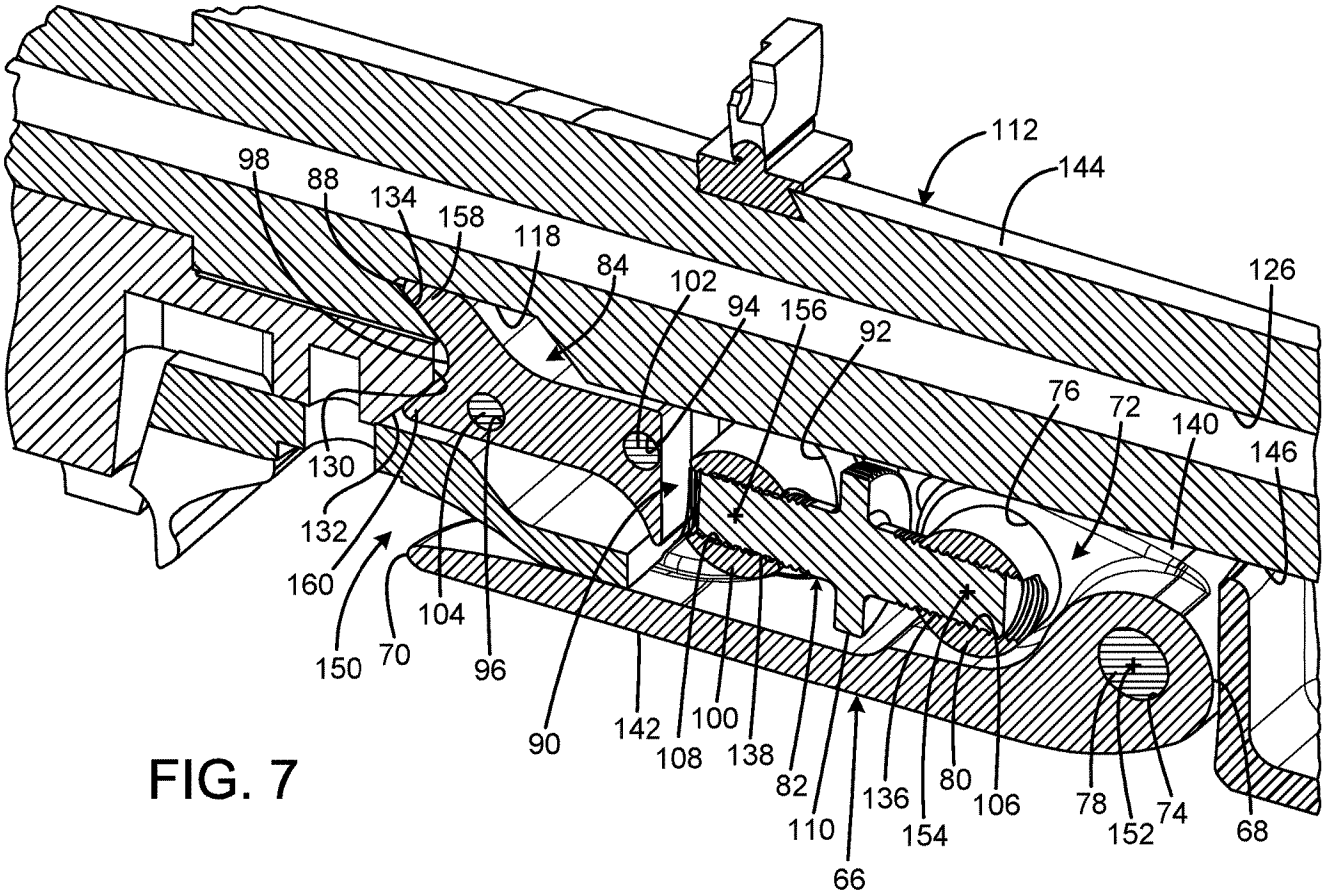
FIG. 7 is a front isometric view of the barrel toggle clamp of FIG. 1 in the clamped position.
Figure 8:
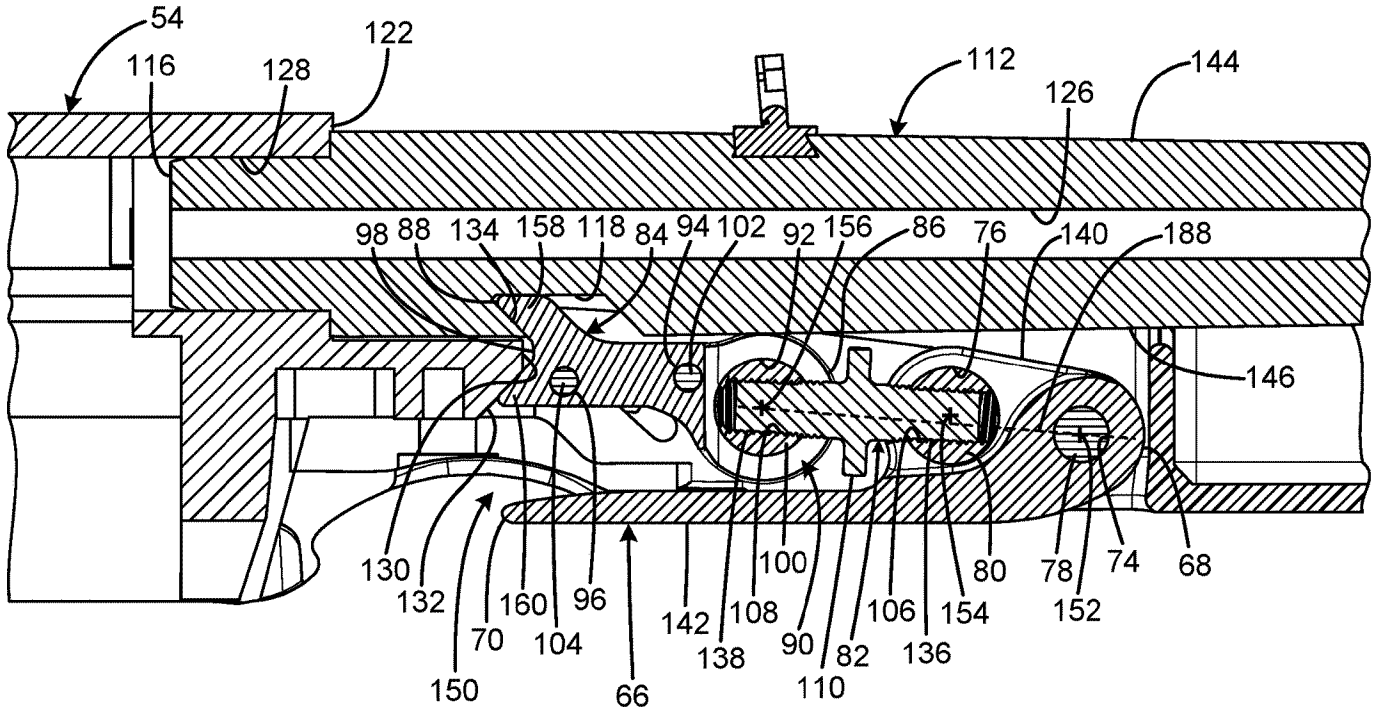
FIG. 8 is a right side view of the barrel toggle clamp of FIG. 1 in the clamped position.

FIGS. 7 and 8 illustrate the improved folding stock with barrel toggle clamp 10 of the present invention. More particularly, the stock is shown with the lever 66 and V-block in the clamped position, which biases the barrel 112 rearward toward the receiver channel portion 30. The rear 116 of the barrel 112 is received within a central bore 128 in the front 122 of the receiver 54 to secure the barrel to the receiver such that a cartridge can be chambered within the rear of the barrel bore 126. The front of the receiver defines a receiver protrusion 130 that extends forwardly beneath the rear of the barrel. The receiver protrusion defines an angled surface 132. The rear of the notch 118 in the bottom 146 of the barrel defines an angled surface 134. The angled surfaces 132, 134 are closely received within the V notch 98 of the V-block 84. When the lever is pivoted clockwise about the pivot pin 78, the turnbuckle 82 urges the V-block upwards and rearwards. The front and rear guide pins 102, 104 slide within the front and rear guide slots 50, 52 to urge the rear 88 of the V-block against the angled surfaces 132, 134 to receive the angled surfaces within the V notch 98 to releasably secure the rear of the barrel within the central bore of the receiver. The rear of the barrel is a slip fit relative to the central bore of the receiver and does not have to retain any gas pressure. When the lever is in the clamped position, the bottom 142 of the lever is parallel to and flush with the bottom external surface 20 of the forend 12 of the stock 10 forward of the receiver channel portion 30, and the rear 70 protrudes into a gap 150 to facilitate pivoting of the lever in a counterclockwise direction about the pivot pin to release the barrel.

Figure 9:
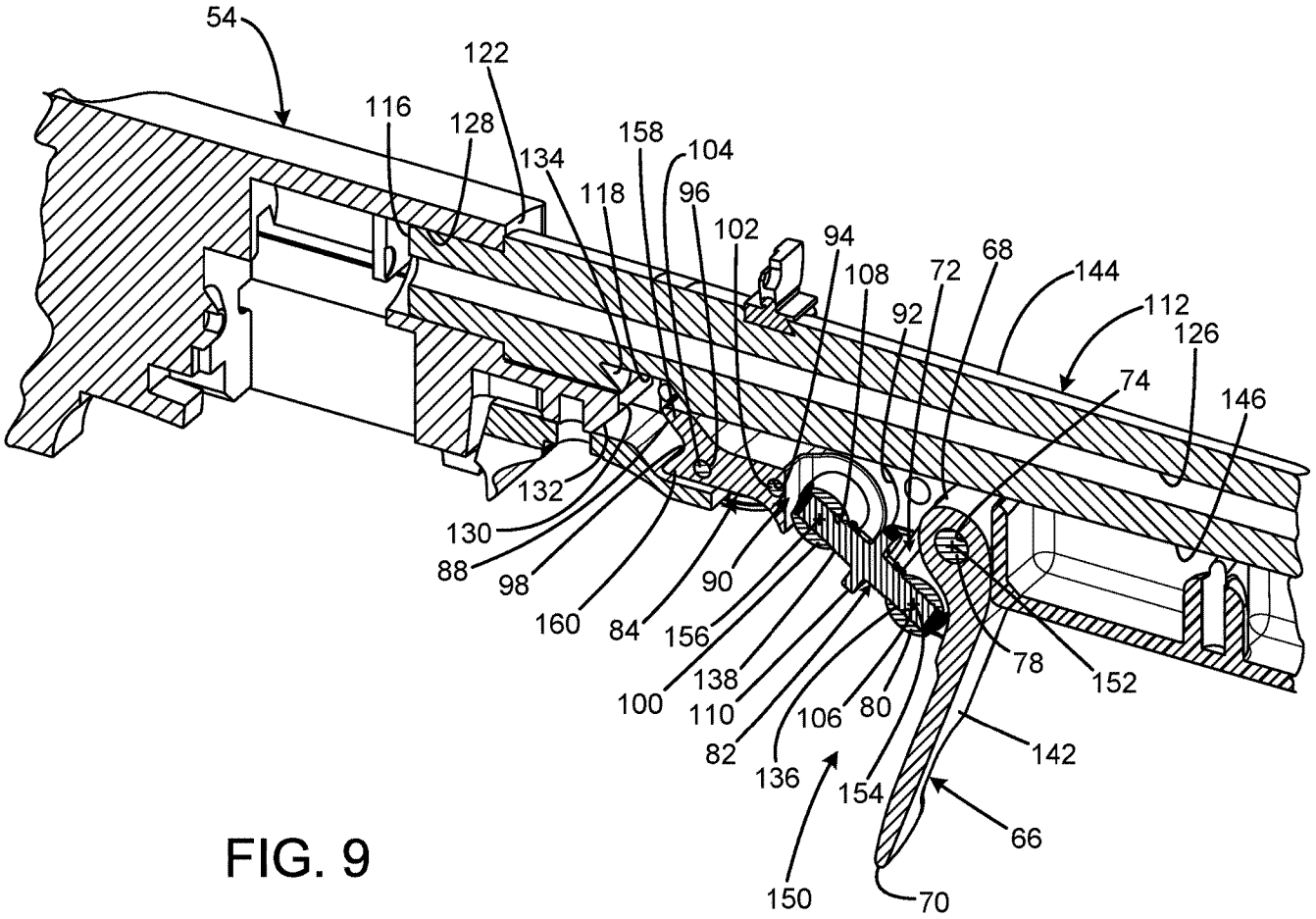
FIG. 9 is a front isometric view of the barrel toggle clamp of FIG. 1 in the released position.
Figure 10:
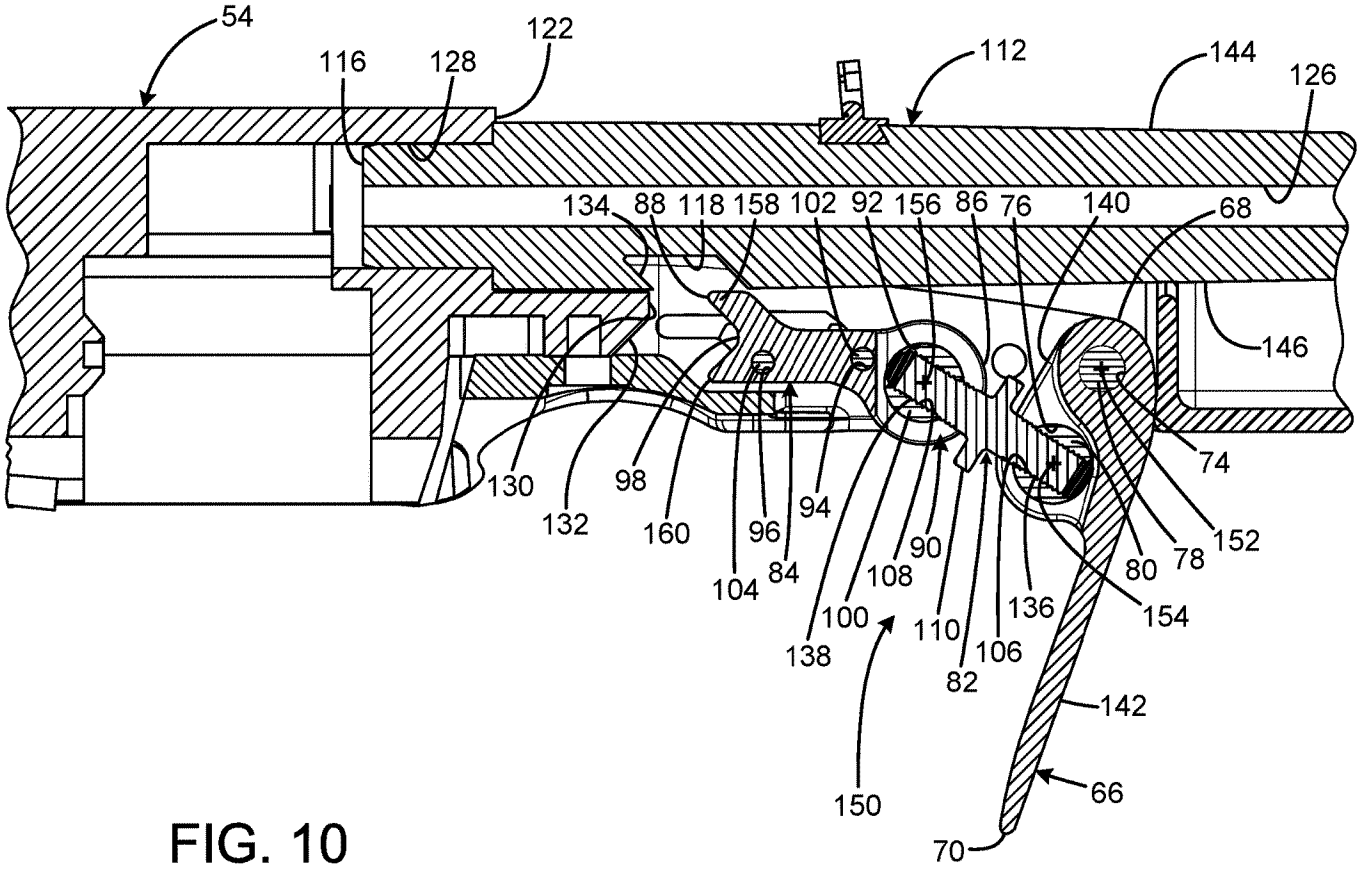
FIG. 10 is a right side view of the barrel toggle clamp of FIG. 1 in the released position.

FIGS. 9 and 10 illustrate the improved folding stock with barrel toggle clamp 10 of the present invention. More particularly, the stock is shown with the lever 66 and V-block 84 in the released position. When the lever is pivoted counterclockwise about the pivot pin 78, the turnbuckle 82 pulls the V-block downwards and forwards. The front and rear guide pins 102, 104 slide within the front and rear guide slots 50, 52 to pull the rear 88 of the V-block away from the angled surfaces 132, 134 and to withdraw the V-block from the notch 118 in the bottom 146 of the barrel. As a result, the rear 116 of the barrel 112 is no longer secured within the central bore 128 of the front 122 of the receiver 54, which enables a user to grasp the barrel and pull the barrel forward out of the receiver and the barrel slot 42 of the chassis 32 and the barrel channel portion 28 of the forend 12. The user can then stow the barrel within the barrel compartment 148 after the stock 10 is folded.

The amount of clamping force exerted by the V-block 84 can be fine-tuned by the user by using thumb wheel 110 on the turnbuckle 82 to change the amount of engagement of the front threaded end 136 with the barrel nut 80 and the amount of engagement of the rear threaded end 138 with the barrel nut 100. This adjustment enables spacing adjustments for different barrels 112 and/or receivers 54, either of which can be supplied by the original equipment manufacturer or an aftermarket producer. This adjustment also determines the tension between the lever 66 and V-block and how much force is required to pivot the lever 66 into the clamped and released positions. It is desirable that enough continuous tension be conducted to the pivot pin 78 and continuous compression conducted to the V-block such that deliberate force is required to open the lever to the released position. The lever pivots on a pivot pin axis 152, which is a first horizontal axis lateral to the stock 10. The turnbuckle is an adjustable length link pivotally connected to the lever to pivot on a front barrel nut axis 154, which is a second horizontal axis parallel to the pivot pin axis. The V-block is pivotally connected to the turnbuckle to pivot on a rear barrel nut axis 156, which is a third horizontal axis parallel to the pivot pin axis. The pivot pin axis is lower than the front barrel nut axis, which in turn is lower than the rear barrel nut axis, which in turn is lower than the upper leg 158 of the V-block. As a result, the clamp mechanism is an over-center mechanism that is stable in the clamped position because compression force will tend to hold the lever closed when the lever is in the clamped position. The pivot pin and rear barrel nut axes (the first and third horizontal axes) define a selected plane of stability 188 between the pivot pin axis and the rear barrel nut axis. The front barrel nut axis (the second axis) is on one side of the selected plane when in the released position, and on the other side of the plane when in the clamped position, such that an over-center stable condition is provided in the clamped position. Thus, the front barrel nut axis is above the selected plane when in the clamped position, and compressive force on the linkage creates a stable condition. The V-block cannot buckle when the lever cams over and forces the V-block rearward against the angled surfaces 132, 134 because of the engagement of the front and rear guide pins 102, 104 with the front and rear guide slots 50, 52.

While a current embodiment of the folding stock with barrel toggle clamp has been described in detail, it should be apparent that modifications and variations thereto are possible, all of which fall within the true spirit and scope of the invention. For example, the invention can also be viewed as a complete takedown rifle in addition to a folding stock with barrel toggle clamp. Furthermore, the invention is suitable for use with other firearms, including shotguns, AR-15 rifles, and bolt action rifles. In addition, the left and right cover plates could be structural members if they were manufactured from a suitable material such as carbon fiber or aluminum. Instead of the cast or machined aluminum chassis described, the chassis could also be made of cast or machined steel, or stamped steel side plates. The clamp mechanism could be made without the internal turnbuckle, and instead have a frame that slides and adjusts the distance of the lever pivot pin to the barrel locking surface. The clamp mechanism could also be accomplished with inclined planes and a jack screw or a releasable ratchet system. Finally, the stock could also omit the chassis, and instead use a material for the stock with a high strength, such as carbon fiber, with inserts that provide the pin tracks and pivot pin bushings otherwise provided by the chassis. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle stock for an action with a detachable barrel, the stock comprising:

a body having a butt end, and defining a receptacle adapted to receive the action;

a clamp mechanism on the body operable to move between a released position and a clamped position;

the clamp mechanism operable to bias the barrel toward the butt end to secure the barrel to the action; and wherein the clamp mechanism includes a V-block defining a channel adapted to receive a protrusion on the receiver and an angled surface on the barrel to clamp the barrel to the receiver.

2. The rifle stock of claim 1 wherein the clamp mechanism is a multi-link linkage.

3. The rifle stock of claim 2 wherein one of the links has an adjustable length.

4. The rifle stock of claim 1 wherein the clamp mechanism includes a lever that is flush against an external surface of the stock when in the clamped position.

5. The rifle stock of claim 1 wherein the clamp mechanism includes a lever pivotally connected to the body to pivot on a first horizontal axis lateral to the body.

6. The rifle stock of claim 5 wherein the clamp mechanism includes a link pivotally connected to the lever to pivot on a second horizontal axis parallel to the first axis.

7. The rifle stock of claim 6 wherein the link has an adjustment mechanism adapted to provide a selected length within a range of lengths.

8. The rifle stock of claim 1 wherein the body defines a lower surface forward of the receptacle, and the clamp mechanism includes a planar lever adapted to be flush with the lower surface when in the clamped position.

9. The rifle stock of claim 1 wherein the body is an elongated molded plastic part including a metal insert associated with the receptacle and defining apertures to receive pins connecting the action to the insert.

10. A rifle stock for an action with a detachable barrel, the stock comprising:

a body having a butt end, and defining a receptacle adapted to receive the action;

a clamp mechanism on the body operable to move between a released position and a clamped position;

the clamp mechanism operable to bias the barrel toward the butt end to secure the barrel to the action;

wherein the clamp mechanism includes a lever pivotally connected to the body to pivot on a first horizontal axis lateral to the body;

wherein the clamp mechanism includes a link pivotally connected to the lever to pivot on a second horizontal axis parallel to the first axis; and wherein the clamp mechanism includes a V-block pivotally connected to the link to pivot on a third horizontal axis parallel to the first axis.

11. The rifle stock of claim 10 wherein the V-block is connected to the link at a rearward end and has an opposed rear end defining a horizontal channel parallel to the third axis.

12. The rifle stock of claim 10 wherein the clamp mechanism is an over-center mechanism that is stable in the clamped position.

13. The rifle stock of claim 10 wherein the first and third axes define a selected plane, and the second axis is on one side of the selected plane when in the released position, and on the other side of the plane when in the clamped position, such that an over-center stable condition is provided in the clamped position.

14. A rifle stock for an action with a detachable barrel, the stock comprising:

a body having a butt end, and defining a receptacle adapted to receive the action;

a clamp mechanism on the body operable to move between a released position and a clamped position;

the clamp mechanism operable to bias the barrel toward the butt end to secure the barrel to the action;

wherein the clamp mechanism includes a lever pivotally connected to the body to pivot on a first horizontal axis lateral to the body;

wherein the clamp mechanism includes a link pivotally connected to the lever to pivot on a second horizontal axis parallel to the first axis; and wherein the link is a shaft having oppositely threaded ends, such that rotation of the shaft enables adjustment of an effective length of the link.

15. The rifle stock of claim 14 wherein the lever defines a bore rotatably receiving a pin defining a first axis, and wherein the pin defines a threaded bore perpendicular to the first axis and receiving the link.

16. A rifle stock for an action with a detachable barrel, the stock comprising:

a body having a butt end, and defining a receptacle adapted to receive the action;

a clamp mechanism on the body operable to move between a released position and a clamped position;

the clamp mechanism operable to bias the barrel toward the butt end to secure the barrel to the action;

wherein the body is an elongated molded plastic part including a metal insert associated with the receptacle and defining apertures to receive pins connecting the action to the insert; and wherein the insert has a forward extending element defining a facility connected to the clamp mechanism, such that compression generated by the clamping mechanism between the barrel and action is supported by tension in the insert.

17. The rifle stock of claim 16 wherein the clamp mechanism includes a V-block defining a channel adapted to receive a protrusion on the receiver and an angled surface on the barrel to clamp the barrel to the receiver.

18. A rifle comprising;

a stock defining a receptacle and having a butt;

an action removably received in the receptacle;

a barrel removably connected to the action;

the stock including a clamp mechanism on the body operable to move between a released position and a clamped position;

the clamp mechanism operable to bias the barrel toward the butt to secure the barrel to the receiver;

the clamp mechanism including a lever pivotally connected to the body to pivot on a first horizontal axis lateral to the body;

the clamp mechanism including a link pivotally connected to the lever to pivot on a second horizontal axis parallel to the first axis; and the clamp mechanism includes a V-block pivotally connected to the link to pivot on a third horizontal axis parallel to the first axis.

19. The rifle of claim 18 wherein the link has an adjustable length.

20. The rifle of claim 18 where the clamp mechanism includes V-block defining a channel adapted to receive a protrusion on the receiver and an angled surface on the barrel to clamp the barrel to the receiver.

21. A rifle stock for an action with a detachable barrel, the stock comprising:

a body defining a receptacle adapted to receive the action;

a clamp mechanism on the body operable to move between a released position and a clamped position;

the clamp mechanism being a linkage having a plurality of links and operable to secure the barrel to the action;

one of the links being an adjustable link having an adjustor element operable to establish a selected length of the link; and wherein the adjustor element has oppositely threaded ends, such that rotation of the adjustor element enables adjustment of an effective length of the link.

22. The rifle stock of claim 21 wherein the clamp mechanism includes a lever that is flush against an external surface of the stock when in the clamped position.

23. The rifle stock of claim 21 wherein the clamp mechanism includes a lever pivotally connected to the body to pivot on a first horizontal axis lateral to the body.

24. The rifle stock of claim 21 wherein the clamp mechanism is an over-center mechanism that is stable in the clamped position.

25. The rifle stock of claim 21 wherein the adjustable link includes a threaded portion operable to adjust the length of the link by rotation.

26. The rifle stock of claim 21 wherein the clamp mechanism includes a V-block defining a channel adapted to receive a protrusion on the receiver and an angled surface on the barrel to clamp the barrel to the receiver.

27. A rifle stock for an action with a detachable barrel, the stock comprising:

a body defining a receptacle adapted to receive the action;

a clamp mechanism on the body operable to move between a released position and a clamped position;

the clamp mechanism being a linkage having a plurality of links and operable to secure the barrel to the action;

one of the links being an adjustable link having an adjustor element operable to establish a selected length of the link; and wherein the clamp mechanism includes a V-block defining a channel adapted to receive a protrusion on the receiver and an angled surface on the barrel to clamp the barrel to the receiver.

28. The rifle stock of claim 27 wherein the adjustor element has oppositely threaded ends, such that rotation of the adjustor element enables adjustment of an effective length of the link.

29. A rifle stock for an action with a detachable barrel, the stock comprising:

a body defining a receptacle adapted to receive the action;

a clamp mechanism on the body operable to move between a released position and a clamped position;

the clamp mechanism being a linkage having a plurality of links and operable to secure the barrel to the action;

one of the links being an adjustable link having an adjustor element operable to establish a selected length of the link;

wherein the body is an elongated molded plastic part including a metal insert associated with the receptacle and defining apertures to receive pins connecting the action to the insert; and wherein the insert has a forward extending element defining a facility connected to the clamp mechanism, such that compression generated by the clamping mechanism between the barrel and action is supported by tension in the insert.

30. A rifle stock for an action with a detachable barrel, the stock comprising:

a body defining a receptacle adapted to receive the action;

a clamp mechanism on the body operable to move between a released position and a clamped position;

the clamp mechanism operable to removably secure the barrel to the action;

the clamp mechanism including a lever pivotally connected to the body to pivot on a first horizontal axis lateral to the body;

the clamp mechanism including a link pivotally connected to the lever to pivot on a second horizontal axis parallel to the first axis;

wherein the clamp mechanism includes a V-block pivotally connected to the link to pivot on a third horizontal axis parallel to the first axis; and wherein the V-block defines a horizontal channel parallel to the third axis.

* * * * *